US011499266B2

(12) United States Patent
Nakayama et al.

(10) Patent No.: US 11,499,266 B2
(45) Date of Patent: Nov. 15, 2022

(54) GRAINED ARTIFICIAL LEATHER AND METHOD FOR MANUFACTURING GRAINED ARTIFICIAL LEATHER

(71) Applicant: KURARAY CO., LTD., Kurashiki (JP)

(72) Inventors: Kimio Nakayama, Okayama (JP); Hayaki Sato, Okayama (JP); Naoto Narumoto, Okayama (JP); Akihisa Iwamoto, Okayama (JP)

(73) Assignee: KURARAY CO., LTD., Kurashiki (JP)

( * ) Notice: Subject to any disclaimer, the term of this patent is extended or adjusted under 35 U.S.C. 154(b) by 457 days.

(21) Appl. No.: 16/494,820

(22) PCT Filed: May 21, 2018

(86) PCT No.: PCT/JP2018/019537
§ 371 (c)(1),
(2) Date: Sep. 17, 2019

(87) PCT Pub. No.: WO2018/221301
PCT Pub. Date: Dec. 6, 2018

(65) Prior Publication Data

US 2020/0277730 A1 Sep. 3, 2020

(30) Foreign Application Priority Data

May 31, 2017 (JP) ..... JP2017-108179

(51) Int. Cl.
*D06N 3/00* (2006.01)
*D06N 3/04* (2006.01)
*D06N 3/14* (2006.01)

(52) U.S. Cl.
CPC ..... *D06N 3/0004* (2013.01); *D06N 3/009* (2013.01); *D06N 3/0011* (2013.01); *D06N 3/0063* (2013.01); *D06N 3/042* (2013.01); *D06N 3/14* (2013.01)

(58) Field of Classification Search
CPC ..... D06N 3/0004; D06N 3/0011; D06N 3/0063; D06N 3/009; D06N 3/042; D06N 3/14
See application file for complete search history.

(56) References Cited

U.S. PATENT DOCUMENTS 3,705,226 A * 12/1972 Okamoto ..... B32B 27/40 264/162
4,146,663 A * 3/1979 Ikeda ..... B32B 5/26 428/96
2003/0232555 A1 12/2003 Nobuto et al.
2016/0002846 A1 1/2016 Yoshimoto et al.
2019/0153666 A1 5/2019 Nakayama et al.

FOREIGN PATENT DOCUMENTS

JP 59-100772 A 6/1984
JP 2002-115183 A 4/2002
JP 2004-19010 A 1/2004
JP WO2014/132630 A1 9/2014
JP 2016-6241 A 1/2016
JP 2017-2419 A 1/2017
JP WO2017/082273 A1 5/2017
JP WO2017/195661 A1 11/2017

OTHER PUBLICATIONS

International Search Report dated Jul. 10, 2018 in PCT/JP2018/019537 filed on May 21, 2018.

* cited by examiner

*Primary Examiner* — Cephia D Toomer
(74) *Attorney, Agent, or Firm* — Oblon, McClelland, Maier & Neustadt, L.L.P.

(57) ABSTRACT

Disclosed is a grain-finished artificial leather including an artificial leather base material, and a grain layer stacked on the artificial leather base material. The artificial leather base material includes a fiber-entangled body including ultrafine fibers having an average fineness of 0.4 dtex or less, an elastic polymer, and fine particles having an average particle size of 10 μm or less. The content ratio of the fine particles is 10 to 40 mass %, and the ratio of the elastic polymer to the total amount of the elastic polymer and the fine particles is 20 to 80 mass %. Also, a total of an apparent density of the elastic polymer and an apparent density of the fine particles is 0.23 to 0.55 g/cm$^3$.

14 Claims, No Drawings

GRAINED ARTIFICIAL LEATHER AND METHOD FOR MANUFACTURING GRAINED ARTIFICIAL LEATHER

TECHNICAL FIELD

The present invention relates to a grain-finished artificial leather having a combination of fine fold creases, suppleness, surface smoothness, and a texture with fullness, similar to those of a grain-finished leather.

BACKGROUND ART

Conventionally, a grain-finished artificial leather is known in which a grain-like resin layer (hereinafter also simply referred to as "grain layer") is stacked on an artificial leather base material obtained by impregnating an elastic polymer into voids inside a fiber-entangled body. The grain-finished artificial leather has been used as an alternative to a grain-finished leather for the skin materials of shoes, clothing, gloves, bags, balls, and the like, and the interior finishing materials for buildings and vehicles.

A grain-finished leather using a natural leather as a raw material includes dense collagenous fibers, and thus has both suppleness and a high level of fullness (voluminousness). When a grain-finished leather is bent, its high level of fullness allows the formation of fine fold creases with roundness and luxurious quality. In addition, a grain-finished leather has excellent surface flatness, and unevenness is less likely to be conspicuous even when a grain surface is formed, so that the surface smoothness is high. However, it has been difficult to obtain a grain-finished leather with stable quality. Moreover, collagenous fibers have low heat resistance and low water resistance. Therefore, it has been difficult to use a grain-finished leather in applications for which heat resistance and water resistance are required. To increase the heat resistance and the water resistance of the grain-finished leather, a method is available in which a thick grain layer is formed. However, when a thick grain layer is formed, the suppleness, which is an advantage of a grain-finished leather, is reduced.

On the other hand, the grain-finished artificial leather is superior to a grain-finished leather in quality stability, heat resistance, water resistance, and abrasion resistance, and is also easier to maintain. However, voids that are not filled with the elastic polymer remain inside the fiber-entangled body of the grain-finished artificial leather. Accordingly, when bent, the grain-finished artificial leather does not bend with roundness as in the case of a grain-finished leather, and, instead, forms buckled creases or large fold creases, resulting in the problem that it is inferior in luxurious quality. When the number of voids is decreased by increasing the content ratio of the elastic polymer in the fiber-entangled body, the resilience of the elastic polymer increases, resulting in a rubber-like, rigid texture. As a grain-finished artificial leather having a texture similar to that of a grain-finished leather, for example, PTL 1 listed below discloses a grain-finished artificial leather with a high level of fullness that is obtained by stacking a grain-like resin layer on an artificial leather base material containing a filler, a liquid non-volatile oil, and an elastic polymer. However, the grain-finished artificial leather described in PTL 1 does not form sufficiently fine fold creases as compared with a grain-finished leather.

CITATION LIST

Patent Literature

[PTL 1] WO 2014/132630

SUMMARY OF INVENTION

Technical Problem

It is an object of the present invention to provide a grain-finished artificial leather having a combination of the formability of fine fold creases, suppleness, surface smoothness, and a texture with fullness, similar to those of a grain-finished leather.

Solution to Problem

One aspect of the present invention is directed to a grain-finished artificial leather including an artificial leather base material, and a grain layer stacked on the artificial leather base material. The artificial leather base material includes a fiber-entangled body including ultrafine fibers having an average fineness of 0.4 dtex or less, an elastic polymer, and fine particles having an average particle size of 10 μm or less, and a content ratio of the fine particles is 10 to 40 mass %, and a ratio of the elastic polymer to a total amount of the elastic polymer and the fine particles is 20 to 80 mass %, and a total of an apparent density of the elastic polymer and an apparent density of the fine particles is 0.23 to 0.55 g/cm$^3$. Such a grain-finished artificial leather has a combination of the formability of fine fold creases, suppleness, surface smoothness, and a texture with fullness.

It is preferable that the artificial leather base material has a content ratio of the fiber-entangled body of 30 to 80 mass %, and a content ratio of the elastic polymer of 10 to 40 mass %, because a grain-finished artificial leather that is particularly well-balanced in formability of fine fold creases, suppleness, surface smoothness, and a texture with fullness can be easily obtained.

It is preferable that the fine particles are attached to the elastic polymer, because the detachment of the fine particles is suppressed.

It is preferable that the elastic polymer includes a polyurethane and an acrylic elastic polymer, because a grain-finished artificial leather that is particularly well-balanced in formability of fine fold creases, suppleness, surface smoothness, and a texture with fullness can be easily obtained.

It is preferable that the fine particles have a Mohs hardness of 1 to 4, because a grain-finished artificial leather having further excellent suppleness can be obtained.

It is preferable that the fine particles include at least one selected from the group consisting of talc, magnesium silicate, calcium sulfate, aluminum silicate, calcium carbonate, magnesium oxide, magnesium carbonate, magnesium hydroxide, aluminum hydroxide, and mica.

It is preferable that the artificial leather base material further includes a plasticizer, because the texture having both suppleness and fullness of the grain-finished artificial leather can be easily further enhanced. It is particularly preferable that the plasticizer is liquid at 23° C.

It is preferable that the artificial leather base material has an apparent density of 0.45 to 0.8 g/cm$^3$, because a grain-finished artificial leather that is particularly well-balanced in suppleness, surface smoothness, and a texture with fullness can be easily obtained.

It is preferable that the ultrafine fibers having an average fineness of 0.4 dtex or less include nylon ultrafine fibers having an average fineness of 0.025 dtex or less, because a grain-finished artificial leather having particularly excellent suppleness can be easily obtained.

It is preferable that an arithmetic mean height $S_a$ of a surface of the grain layer is 30 μm or less when the grain-finished artificial leather is caused to extend in a semicircular shape along an outer surface of a cylindrical mandrel having an outer radius of 8.7 mm, with the grain layer located on an inner side. Such a grain-finished artificial leather has a combination of fine fold creases, suppleness, surface smoothness, and a texture with fullness, similar to those of a grain-finished leather.

Another aspect of the present invention is directed to a method for producing a grain-finished artificial leather, including the steps of: preparing an artificial leather base material; and forming a grain layer on a surface of the artificial leather base material by direct coating, wherein the artificial leather base material includes a fiber-entangled body including ultrafine fibers having an average fineness of 0.4 dtex or less, an elastic polymer, and fine particles having an average particle size of 10 μm or less, a content ratio of the fine particles is 10 to 40 mass %, and a ratio of the elastic polymer to a total amount of the elastic polymer and the fine particles is 20 to 80 mass %, and a total of an apparent density of the elastic polymer and an apparent density of the fine particles is 0.23 to 0.55 g/cm$^3$.

It is preferable that the step of forming a grain layer on a surface of the artificial leather base material by direct coating includes the steps of: forming an undercoat layer by applying a solution of an undercoat layer-forming elastic polymer to a surface of the artificial leather base material, followed by drying; and forming a skin layer by applying a resin solution including a skin layer-forming elastic polymer to a surface of the undercoat layer, because a thin grain layer can be formed.

It is preferable that a water absorption time when 3 cc of water droplets are dripped to the surface of the undercoat layer is 3 minutes or more, because a resin solution including a skin layer-forming elastic polymer does not excessively permeate into the artificial leather base material when the resin solution is applied.

Advantageous Effects of Invention

According to the present invention, it is possible to obtain a grain-finished artificial leather having a combination of the formability of fine fold creases, suppleness, surface smoothness, and a texture with fullness, similar to those of a grain-finished leather.

DESCRIPTION OF EMBODIMENT

Hereinafter, an embodiment of the grain-finished artificial leather according to the present invention will be described in detail.

A grain-finished artificial leather according to the present embodiment is a grain-finished artificial leather including an artificial leather base material, and a grain layer stacked on the artificial leather base material. The artificial leather base material includes a fiber-entangled body including ultrafine fibers having an average fineness of 0.4 dtex or less (hereinafter, the ultrafine fibers are also referred to as the "ultrafine fibers", and the fiber-entangled body is also simply referred to as the "fiber-entangled body"), an elastic polymer, and a fine particles having an average particle size of 10 μm or less (hereinafter, the fine particles are also referred to as the "fine particles"). In the artificial leather base material, the content ratio of the fine particles is 10 to 40 mass %, and the ratio of the elastic polymer to the total amount of the elastic polymer and the fine particles is 20 to 80 mass %. Furthermore, in the artificial leather base material, a total of an apparent density of the elastic polymer and an apparent density of the fine particles is 0.23 to 0.55 g/cm$^3$.

Examples of the fiber-entangled body including the ultrafine fibers include fiber structures including ultrafine fibers, such as a non-woven fabric, a woven fabric, and a knitted fabric. Among these, a non-woven fabric of ultrafine fibers is particularly preferable because it has a high fiber density and thus has low density unevenness and high homogeneity. Here, a non-woven fabric of ultrafine fibers serving as a fiber-entangled body of ultrafine fibers will be described in detail as a representative example.

The non-woven fabric of ultrafine fibers is obtained, for example, by subjecting ultrafine fiber-generating fibers such as island-in-the-sea (matrix-domain) composite fibers to entangling treatment, and then to ultrafine fiber-generating treatment. Although the present embodiment describes in detail a case where the island-in-the-sea composite fibers are used, it is possible to use ultrafine fiber-generating fibers other than the island-in-the-sea composite fibers, or to directly spin ultrafine fibers without using ultrafine fiber-generating fibers.

In production of a non-woven fabric of ultrafine fibers, first, a thermoplastic resin for forming a sea component (matrix component), which is to be selectively removed, of island-in-the-sea composite fibers, and a thermoplastic resin for forming an island component (domain component), which is a resin component for forming ultrafine fibers, of the island-in-the-sea composite fibers are melt spun and then stretched, thus producing island-in-the-sea composite fibers.

As the thermoplastic resin for the sea component, a thermoplastic resin that differs from the resin for the island component in solubility in a solvent or in decomposability in a decomposition agent is selected. Specific examples of the thermoplastic resin for forming the sea component include polyethylenes, water-soluble polyvinyl alcohol-based resins, polypropylenes, polystyrenes, ethylene-propylene resins, ethylene-vinyl acetate resins, styrene-ethylene resins, and styrene-acrylic resins.

The thermoplastic resin for the island component is not particularly limited as long as it is a resin capable of forming ultrafine fibers. Specific examples thereof include aromatic polyesters such as polyethylene terephthalate (PET), isophthalic acid-modified PET (IPA-PET), sulfoisophthalic acid-modified PET, polybutylene terephthalate, and polyhexamethylene terephthalate; aliphatic polyesters such as polylactic acid, polyethylene succinate, polybutylene succinate, polybutylene succinate adipate, and a polyhydroxybutyrate-polyhydroxyvalerate resin; nylons such as nylon 6, nylon 66, nylon 10, nylon 11, nylon 12, and nylon 6-12; and polyolefins such as polypropylene, polyethylene, polybutene, polymethylpentene, and a chlorine-based polyolefin. These may be used alone or in a combination of two or more. Among these, nylon or an aromatic polyester, in particular, nylon is particularly preferable in terms of excellent suppleness. In order to adjust the fiber characteristics, additives such as a softening agent, a fiber ordering agent, an antifouling agent, a hydrophilizing agent, a lubricant, a degradation inhibitor, an ultraviolet absorber, and a flame retardant may be mixed in the thermoplastic resin for the island component. Note that such additives mixed in the ultrafine fibers are not included as a constituent of the fine particles having an average particle size of 10 μm or less.

Examples of the production method of the non-woven fabric of ultrafine fibers include a method in which island-in-the-sea composite fibers are melt spun to produce a web, and the web is subjected to entangling treatment, and thereafter the sea component is selectively removed from the island-in-the-sea composite fibers, to form ultrafine fibers. Examples of the production method of the web include a method in which filaments of the island-in-the-sea composite fibers that have been spun by spunbonding or the like are collected on a net, without being cut, to form a filament web, and a method in which filaments are cut into staples to form a staple web. Among these, a filament web is particularly preferable because a non-woven fabric having excellent denseness and excellent fullness can be obtained. The formed web may be subjected to fusion bonding treatment in order to impart shape stability thereto. Examples of the entangling treatment include a method in which about 5 to 100 layers of the web are placed on top of each other, and subjected to needle punching or high-pressure water jetting treatment.

Note that a filament means a continuous fiber, rather than a staple that has been intentionally cut after being spun. More specifically, a filament means a fiber other than a staple that has been intentionally cut so as to have a fiber length of about 3 to 80 mm, for example. The fiber length of the island-in-the-sea composite fibers before being subjected to ultrafine fibers generation is preferably 100 mm or more, and may have a fiber length of several meters, several hundred meters, several kilometers, or more, as long as the fibers are technically producible and are not inevitably cut during the production process. Note that some of filaments may be inevitably cut into short fibers during the production process by needle punching during entanglement or surface buffing.

In any of the processes until the sea component of the island-in-the-sea composite fibers is removed to form ultrafine fibers, fiber shrinking treatment such as heat shrinking treatment using water vapor may be performed to densify the island-in-the-sea composite fibers, thus making it possible to enhance the fullness of the non-woven fabric.

The sea component of the island-in-the-sea composite fibers is removed by dissolution or decomposition at an appropriate stage after the web has been formed. Through removal by dissolution or removal by decomposition of the sea component, the island-in-the-sea composite fibers are subjected to ultrafine fiber generation, and ultrafine fibers in the form of fiber bundles are formed.

The average fineness of the ultrafine fibers is 0.4 dtex or less, preferably 0.2 dtex or less, more preferably 0.025 dtex or less. When the average fineness exceeds 0.4 dtex, the fibers tend to be rigid, so that the suppleness and the surface smoothness are likely to be reduced. Although the lower limit is not particularly limited, the average fineness is preferably about 0.001 dtex. As for the average fineness, a cross section of the grain-finished artificial leather in the thicknesses direction is imaged using a scanning microscope with a magnification of 2000×, to obtain a cross-sectional area of single fibers, and the fineness of a single fiber can be calculated from the cross-sectional area and the specific gravity of the resin that forms the fibers. The average fineness can be defined as an average value of the fineness of average 100 single fibers, evenly obtained from the captured image.

The thus obtained non-woven fabric of ultrafine fibers is subjected to thickness adjustment and planarization treatment, if necessary. Specifically, slicing treatment or buffing treatment is performed. In this manner, a non-woven fabric of ultrafine fibers, which is one form of the fiber-entangled body, is obtained. The thickness of the non-woven fabric is not particularly limited, but is preferably about 0.1 to 3 mm, more preferably about 0.3 to 2 mm.

The artificial leather base material of the present embodiment includes a fiber-entangled body such as a non-woven fabric, an elastic polymer, and fine particles having an average particle size of 10 μm or less. The elastic polymer and the fine particles are applied into voids of the fiber-entangled body.

The elastic polymer is used to enhance the surface smoothness and the fullness of the artificial leather base material, and also to generate fine fold creases in the grain-finished artificial leather, by being filled into the voids of the fiber-entangled body.

The type of the elastic polymer is not particularly limited. Specific examples thereof include polyurethanes, acrylic elastic polymers, diene-based rubbers, nitrile-based rubbers, silicone rubbers, olefin-based rubbers, fluorine-based rubbers, polystyrene-based elastomers, acrylonitrile-styrene copolymers or hydrogenated products or epoxidized products thereof, polyolefin-based elastomers, polyester-based elastomers, nylon-based elastomers, and halogen-based elastomers. These may be used alone or in a combination of two or more. Among these, it is preferable to use a polyurethane or an acrylic elastic polymer as a main component because the formability of fine fold creases, suppleness, surface smoothness, and a texture with fullness can be easily imparted to the grain-finished artificial leather.

Examples of the polyurethane include various polyurethanes obtained by reacting a polymer polyol having an average molecular weight of 200 to 6000, an organic polyisocyanate, and a chain extender at a predetermined molar ratio. Specific examples thereof include polyether urethane, polyester urethane, polyether ester urethane, polycarbonate urethane, polyether carbonate urethane, and polyester carbonate urethane.

A polyurethane having a cross-linked structure is particularly preferable because the water absorption ratio, the adhesion with fibers, and the hardness can be controlled. A cross-linked structure is formed, for example, by adding, to a polyurethane, a self-crosslinking compound containing, in the molecule, two or more functional groups capable of reacting with a functional group included in monomer units that form the polyurethane. Examples of the self-crosslinking compound include a carbodiimide-based compound, an epoxy-based compound, an oxazoline-based compound, or a self-crosslinking compound such as a polyisocyanate-based compound or a multifunctional block isocyanate compound.

The polyurethane has a 100% modulus of preferably 1 to 15 MPa, more preferably 2 to 12 MPa, because a flexible texture can be obtained.

The acrylic elastic polymer can be obtained from a combination of ethylenically unsaturated monomers, specifically, for example, by appropriately combining and polymerizing various monomers of an ethylenically unsaturated monomer, and a cross-linkable monomer or the like used as needed. Note that a cross-linkable monomer is a monomer that causes an acrylic elastic polymer to form a cross-link, and that is capable of forming a cross-linked structure by reacting with an ethylenically unsaturated monomer such as a multifunctional ethylenically unsaturated monomer or a mono- or multifunctional ethylenically unsaturated monomer having a reactive group capable of forming a cross-linked structure.

Specific examples of the ethylenically unsaturated monomer include 2-ethylhexyl acrylate, 2-ethylhexyl methacrylate, lauryl acrylate, lauryl methacrylate, stearyl (meth) acrylate, n-butyl acrylate, isobutyl acrylate, cyclohexyl acrylate, benzyl acrylate, ethyl acrylate, 2-hydroxyethyl acrylate, hydroxypropyl acrylate, 2-hydroxyethyl methacrylate, methyl methacrylate, ethyl methacrylate, diacetone acrylamide, isobutyl methacrylate, isopropyl methacrylate, acrylic acid, methacrylic acid, acrylamide, acrylonitrile, styrene, α-methyl styrene, p-methyl styrene, (meth)acryl amide, diacetone (meth)acrylamide, methyl methacrylate, maleic acid, itaconic acid, fumaric acid, cyclohexyl methacrylate, dimethylaminoethyl methacrylate, diethylaminoethyl methacrylate, vinyl chloride, acrylonitrile, vinyl ether, vinyl ketone, vinyl amide, ethylene, propylene, vinyl pyrrolidone, isopropyl acrylate, n-hexyl methacrylate, n-hexyl acrylate, methyl acrylate, n-butyl methacrylate, hydroxypropyl methacrylate, vinyl acetate, methyl acrylate, n-butyl methacrylate, hydroxypropyl methacrylate, dimethylaminoethyl methacrylate, and diethylaminoethyl methacrylate. These may be used alone or in a combination of two or more.

A cross-linkable monomer is a monomer for causing the acrylic elastic polymer to form a cross-link. Specific examples thereof include multifunctional ethylenically unsaturated monomers such as ethylene glycol di(meth) acrylate, triethylene glycol di(meth)acrylate, polyethylene glycol di(meth)acrylate, 1,4-butanediol di(meth)acrylate, and 1,6-hexanediol di(meth)acrylate; various monomers having a hydroxyl group, such as 2-hydroxyethyl (meth) acrylate and 2-hydroxypropyl (meth)acrylate; mono- or multifunctional ethylenically unsaturated monomers having a reactive group that can form a cross-linked structure, including, for example, a (meth)acrylic acid derivative having an epoxy group, such as glycidyl(meth)acrylate.

The acrylic elastic polymer has a glass transition temperature ($T_g$) of preferably −60 to 20° C., more preferably −60 to 10° C., particularly preferably −50 to −5° C., quite particularly preferably −40 to −10° C., because an artificial leather base material having particularly excellent suppleness can be obtained.

The acrylic elastic polymer has a 100% modulus of preferably 0.3 to 5 MPa, more preferably 0.6 to 4 MPa, because an artificial leather base material having excellent suppleness can be obtained.

Fine particles are applied to the fiber-entangled body. The fine particles are fine particles of a metal, a metal oxide, an inorganic compound, an organic compound other than the elastic polymer, or an inorganic-organic compound that have an average particle size of 10 μm or less, preferably 1 to 7 μm. The fine particles enhance the surface smoothness and the fullness of the artificial leather base material by being filled into the voids of the fiber-entangled body. This contributes to causing the grain-finished artificial leather to exert the formability of fine fold creases. When the average particle size of the fine particles exceeds 10 μm, the fine particles become less likely to be uniformly applied into the voids of the fiber-entangled body, and the surface smoothness is reduced, so that the formability of fold creases is likely to be reduced.

For measurement of the average particle size of the fine particles, it is possible to adopt a known method, including, for example, measurement methods using optical characteristics, such as a method in which the fine particles are directly measured with an optical microscope or an electron microscope at a magnification of 400 to 2000×; laser diffraction scattering; dynamic light scattering; and electrical detection. Note that the average particle size of the fine particles mixed in the grain-finished artificial leather is determined by photographing randomly selected five portions on a cross section of the grain-finished artificial leather with a scanning electron microscope at a magnification of 1000×, measuring the diameters of the fine particles, and calculating the average value of the measured values.

It is particularly preferable that the fine particles have a Mohs hardness of 1 to 4. For example, the Mohs hardness of the fine particles are approximately as follows: graphite (Mohs hardness: 0.5 to 1, the same applies to the following), talc (1), gypsum (1), lead (1.5), calcium sulfate (1.6 to 2), zinc (2), silver (2), amber (2 to 2.5), aluminum silicate (2 to 2.5), cerium oxide (2.5), magnesium hydroxide (2 to 3), mica (2.8), aluminum (2 to 2.9), aluminum hydroxide (3), calcium carbonate (3), magnesium carbonate (3 to 4), marble (3 to 4), copper (2.5 to 4), brass (3 to 4), magnesium oxide (4), zinc oxide (4 to 5), iron (4 to 5), glass (5), iron oxide (6), titanium oxide (5.5 to 7.5), silica (7), alumina (9), silicon carbide (9), and diamond (10). In the production method of the artificial leather base material according to the present embodiment, it is preferable to use fine particles having a Mohs hardness of 4 or less, because an artificial leather base material having a particularly excellent suppleness can be obtained. The Mohs hardness can be measured by a known method. As the hardness, new Mohs hardness, Vickers hardness (HV), Shore hardness (HS), Knoop hardness and so forth are known, in addition to Mohs hardness. A Mohs hardness of 1 to 4 is known to substantially correspond to a Vickers hardness (HV) of 1 to 350, a Shore hardness (HS) of 1 to 40, and a Knoop hardness of 1 to 300. In the present embodiment, fine particles having a hardness that is measured by another hardness measurement method and corresponds to a Mohs hardness of 1 to 4 are also included. As the fine particles, in order to adjust various performances, it is also possible to use, for example, fine particles of a softening agent, a fiber ordering agent, an anti-fouling agent, a hydrophilizing agent, a lubricant, a degradation inhibitor, an ultraviolet absorber, a flame retardant, and the like.

In the artificial leather base material according to the present embodiment, it is preferable to use, as fine particles having a Mohs hardness of 1 to 4, graphite, talc, gypsum, calcium sulfate, amber, aluminum silicate, magnesium hydroxide, mica, aluminum hydroxide, calcium carbonate, magnesium carbonate, magnesium oxide, and it is particularly preferable to use talc, magnesium silicate, calcium sulfate, aluminum silicate, calcium carbonate, magnesium oxide, magnesium carbonate, magnesium hydroxide, aluminum hydroxide, and mica. These fine particles are preferable because they are chemically and thermally stable, fine particles having a high purity are available at a low cost, fine particles having a uniform particle size is readily available, and an artificial leather base material having particularly excellent suppleness and surface smoothness can be easily obtained. These may be used alone or in a combination of two or more.

The absolute specific gravity of the fine particles is preferably 1.2 to 4.5 g/cm$^3$, because a high level of fullness can be easily imparted to the artificial leather base material. When the absolute specific gravity of the fine particles is too high, it tends to be difficult to uniformly apply the fine particles to the fiber-entangled body.

The artificial leather base material may further contain a plasticizer. The plasticizer softens the fiber-entangled body, the elastic polymer, and the fine particles, thus improving the plastic deformability thereof. Examples of the plasticizer include oils and fatty acid esters that are liquid, viscous, wax-like, or solid at room temperature (23° C.). Specific examples thereof include fatty acid esters, hydrocarbon-based oils such as paraffin oil (liquid paraffin), hydrocarbon-based waxes, carnauba waxes, phthalic acid esters, phosphoric acid esters, and hydroxy carboxylic acid esters. These may be used alone or in a combination of two or more. Among these, fatty acid esters are particularly preferable because they are particularly prone to provide a texture including both suppleness and fullness to the artificial leather base material.

Examples of the fatty acid esters include compounds obtained by esterification of an alcohol component and an acid component, such as monohydric alcohol esters, monohydric alcohol esters of polybasic acids, fatty acid esters of polyhydric alcohols and derivatives thereof, and fatty acid esters of glycerin. Specific examples of the fatty acid esters include cetyl 2-ethylhexanoate, coconut fatty acid methyl, methyl laurate, isopropyl myristate, isopropyl palmitate, 2-ethylhexyl palmitate, octyldodecyl myristate, methyl stearate, butyl stearate, 2-ethylhexyl stearate, isotridecyl stearate, methyl oleate, myristyl myristate, stearyl stearate, isobutyl oleate, dinormalalkyl phthalate, di-2-ethylhexyl phthalate, diisononyl phthalate, didecyl phthalate, ditridecyl phthalate, trinormalalkyl trimellitate, tri-2-ethylhexyl trimellitate, triisodecyl trimellitate, diisobutyl adipate, diisodecyl adipate, sorbitan monolaurate, sorbitan monopalmitate, sorbitan monostearate, sorbitan tristearate, sorbitan monooleate, sorbitan trioleate, sorbitan monostearate, sorbitan sesquioleate, sorbitan monolaurate, sorbitan monopalmitate, polyoxyethylene sorbitan monolaurate, polyoxyethylene monopalmitate, polyoxyethylene sorbitan monostearate, polyoxyethylene sorbitan monooleate, polyoxyethylene trioleate, polyoxyethylene sorbitol tetraoleate, sorbitan monolaurate, polyoxyethylene monolaurate, polyoxyethylene monolaurate, polyethylene glycol monostearate, polyethylene glycol monooleate, polyethylene glycol distearate, polyethylene glycol bisphenol A lauric acid ester, pentaerythritol monooleate, pentaerythritol monostearate, pentaerythritol tetrapalmitate, monoglyceride stearate, monoglyceride stearate, monoglyceride palmitate, monoglyceride oleate, mono-diglyceride stearate, 2-ethylhexanoate triglyceride, monoglyceride behenate, mono-diglyceride caprate, triglyceride caprate, and lauryl methacrylate. Among the fatty acid esters, it is preferable to use a fatty acid ester that has a melting point of 60° C. or less, it is more preferable to use a fatty acid ester being liquid at room temperature (23° C.), and it is particularly preferable to use a fatty acid ester of a polyhydric alcohol and a fatty acid having 12 to 18 carbon atoms, because they provide a flexible texture in particular.

The method for applying the elastic polymer, the fine particles, and the optionally used plasticizer to the fiber-entangled body is not particularly limited. In the case of applying the elastic polymer and the fine particles to the fiber-entangled body, they may be applied at once, or may be individually applied in separate steps. Examples of the application method include a method in which a dispersion including the elastic polymer, the fine particles, and the optionally used plasticizer is prepared, and ultrafine fiber-generating fibers or a fiber-entangled body of ultrafine fibers is impregnated with the dispersion, for example, by dip-nipping, followed by solidifying the elastic polymer. The fine particles may be applied without being mixed with the elastic polymer or the plasticizer. Alternatively, the fine particles may be applied after being mixed with the plasticizer. Furthermore, for example, in the case of using two types of elastic polymers, it is also possible to use a method in which a liquid mixture in which a first elastic polymer and the fine particles are dispersed is applied first to the fiber-entangled body, and then solidified, followed by applying a liquid containing a second elastic polymer. When the elastic polymer is an emulsion, the elastic polymer is solidified either by using a solidification liquid after immersing the dispersion in a solidification liquid, or by drying.

For example, when the ultrafine fibers form fiber bundles, the elastic polymer may be present in the voids inside the fiber bundles, or may be present outside the fiber bundles. When the elastic polymer enters inside the fiber bundles, the texture can be adjusted by changing the degree of restraint of the ultrafine fibers forming the fiber bundles. For example, when the elastic polymer is applied to the fiber-entangled body of the island-in-the-sea composite fibers, and thereafter the sea component is removed to form ultrafine fibers, voids, which are portions where the sea component has been removed, are formed inside the ultrafine fiber bundles. When the elastic polymer is applied to such voids, the ultrafine fibers forming the ultrafine fiber bundles are restrained, thus enhancing the shape retainability of the fiber-entangled body including the ultrafine fiber bundles.

Note that the fine particles may be present either inside the elastic polymer, in voids inside the ultrafine fiber bundles, or outside the ultrafine fiber bundles or the elastic polymer. It is preferable that the fine particles are attached to the elastic polymer, and are mainly present inside or on the surface of the elastic polymer, from the viewpoint of inhibiting the detachment of the fine particles. When the fine particles are applied after being mixed with the elastic polymer, the fine particles are uniformly applied to the fiber-entangled body, and the detachment of the fine particles can be suppressed. Accordingly, a grain-finished artificial leather that is particularly excellent in formability of fine fold creases, suppleness, surface smoothness, and a texture with fullness can be obtained.

In the case of using an acrylic elastic polymer as the elastic polymer, the acrylic elastic polymer tends to be degraded or deformed if the acrylic elastic polymer is applied before subjecting the ultrafine fiber-generating fibers to ultrafine fiber generation. Therefore, it is preferable that the acrylic elastic polymer is applied to the fiber-entangled body of ultrafine fibers after the ultrafine fiber-generating fibers have been subjected to ultrafine fiber generation.

In this manner, the artificial leather base material of the present embodiment is obtained. Note that the artificial leather base material may be optionally subjected to: thickness adjustment and planarization treatment by slicing treatment or buffing treatment; or finishing treatment such as flexibilizing treatment by crumpling, softening treatment by milling, reverse seal brushing treatment, antifouling treatment, hydrophilization treatment, lubricant treatment, softener treatment, antioxidant treatment, ultraviolet absorber treatment, fluorescent agent treatment, and flame retardant treatment.

For the purpose of adjusting the fullness and the suppleness of the artificial leather base material, it is also preferable to perform softening processing on the artificial leather base material. The method for softening processing is not particularly limited, but it is preferable to use a method in which the artificial leather base material is brought into close contact with an elastic sheet, and mechanically shrunk in a longitudinal direction (MD on production line), and then subjected to heat treatment in the shrunk state for heat setting. Through such softening processing, it is possible to soften the artificial leather base material, while enhancing the surface smoothness thereof.

The content ratio of the fiber-entangled body in the artificial leather base material is not limited, but is preferably 30 to 80 mass %, because an artificial leather base material that is particularly excellent in surface smoothness, mechanical properties, and shape stability can be easily obtained, and a grain-finished artificial leather having particularly excellent formability of fine fold creases can be obtained.

The content ratio of the fine particles in the artificial leather base material is 10 to 40 mass %, preferably 15 to 40 mass %. When the content ratio of the fine particles is less than 10 mass %, the suppleness and the surface smoothness of the artificial leather base material are reduced, and the formability of fine fold creases of the grain-finished artificial leather is also reduced. When the content ratio of the fine particles exceeds 40 mass %, the fine particles are likely to be detached, resulting in a reduction in the surface smoothness of the artificial leather base material.

Furthermore, the content ratio of the elastic polymer in the artificial leather base material is preferably 10 to 40 mass %, more preferably 20 to 40 mass %, because of the particularly excellent surface smoothness and shape stability of the artificial leather base material, and the particularly excellent formability of fine fold creases of the grain-finished artificial leather. When the content ratio of the elastic polymer is too high, an artificial leather base material having a rubber-like texture tends to be obtained.

The ratio of the elastic polymer to the total amount of the elastic polymer and the fine particles is 20 to 80 mass %, preferably 30 to 80 mass %, more preferably 40 to 80 mass %. When the ratio of the elastic polymer to the total amount of the elastic polymer and the fine particles is less than 20 mass %, it becomes difficult to uniformly apply the fine particles to the fiber-entangled body. When the ratio of the elastic polymer to the total amount of the elastic polymer and the fine particles exceeds 80 mass %, the fine particles are excessively coated with the elastic polymer, so that the surface smoothness and the texture of the artificial leather base material are likely to become hard.

In the case of containing the plasticizer in the artificial leather base material, the content ratio of the plasticizer is not limited, but is preferably 1 to 6 mass %, more preferably 2 to 5 mass %, because the effect of enhancing the suppleness can be easily achieved. When the content ratio of the plasticizer is too high, the plasticizer may bleed out on the surface of the artificial leather base material or the grain-finished artificial leather, thus causing stickiness. In particular, when a fatty acid ester is contained as the plasticizer, preferably 0.5 to 5 mass %, more preferably 1 to 3 mass % of the fatty acid ester is contained.

The apparent density of the artificial leather base material is preferably 0.45 to 0.85 g/cm$^3$, more preferably 0.55 to 0.80 g/cm$^3$, because of the excellent formability of fine fold creases, the excellent surface smoothness, and the excellent fullness. It is preferable that the ultrafine fibers are nylon ultrafine fibers, and have an apparent density of preferably 0.55 to 0.80 g/cm$^3$, more preferably 0.60 to 0.75 g/cm$^3$, because of the particularly excellent suppleness.

The total of the apparent density of the elastic polymer and the apparent density of the fine particles in the apparent density of the artificial leather base material is 0.23 to 0.55 g/cm$^3$, preferably 0.25 to 0.50 g/cm$^3$. When the total of the apparent density of the elastic polymer and the apparent density of the fine particles is less than 0.23 g/cm$^3$, the formability of fold creases and the surface smoothness are likely to be reduced. When the total of the apparent densities of the fine particles and the elastic polymer exceeds 0.55 g/cm$^3$, the suppleness of the artificial leather base material is likely to be reduced.

The thickness of the artificial leather base material is not particularly limited, but is preferably about 0.1 to 3 mm, more preferably about 0.3 to 2 mm.

The grain-finished artificial leather base material of the present embodiment can be obtained by stacking a grain layer, which is a grain-like resin layer, on the surface of the above-described artificial leather base material.

Examples of the method for forming the grain layer on the surface of the artificial leather base material includes: dry forming in which the elastic polymer is coated onto a sheet of release paper, and the coated release paper is attached to the surface of the artificial leather base material; wet forming in which a solution of the elastic polymer is applied to the surface of the artificial leather base material, and then solidified by immersing the artificial leather base material in a solvent or water; film lamination in which a film of the elastic polymer is laminated to the surface of the artificial leather base material; and direct coating in which the elastic polymer is directly coated onto the surface of the artificial leather base material, followed by drying. In the production method of the grain-finished artificial leather base material of the present embodiment, direct coating, which is widely know as a method for forming a natural leather grain surface, is particularly preferable because the formed fold creases can be made finer.

The direct coating is a method in which a coating liquid containing a resin is directly applied to the surface of the artificial leather base material using a roll coater or a spray coater, followed by drying, to stack a resin layer. Since the surface of the artificial leather base material of the present embodiment has a high surface smoothness, the applied coating liquid is less likely to permeate thereinto, and therefore direct coating can be easily employed.

Preferably, the direct coating includes, for example, the steps of: forming an undercoat layer by applying a solution of the elastic polymer to the surface of the artificial leather base material, followed by drying; and forming a skin layer by applying a resin solution containing the elastic polymer to the surface of the undercoat layer, because a thin grain layer resembling a grain-finished leather using a natural leather can be formed. The undercoat layer is formed by a resin film containing the elastic polymer. The resin film has such a thickness with which the water absorption time when 3 cc of water droplets are dripped is 3 minutes or more, and, for example, a resin film having a thickness of preferably 10 to 60 μm can be used. The undercoat layer prevents a resin solution containing the elastic polymer for forming the skin layer from permeating into the artificial leather base material when the resin solution is applied.

In addition, a grain pattern may be formed on the grain layer through emboss processing or the like. Examples of the emboss processing include a method in which a grain pattern is transferred to the surface of the artificial leather base material in a state in which a coating liquid of the resin layer applied to the surface is uncured, followed by curing.

The thickness of the grain layer is preferably 10 to 150 μm, more preferably 30 to 100 μm. It is preferable that the grain layer has such a thickness, because this makes it easy to form a grain layer having an arithmetic mean height $S_a$ of 30 μm or less, attributed to fold creases formed on the grain layer when the grain-finished artificial leather is caused to extend along a cylindrical mandrel, which will be described below. Note that the resin layer that forms the grain layer may have a monolayer structure, or may have a stacked structure including the skin layer and an adhesive layer, for example.

As the resin for forming the grain layer, any elastic polymer that has been conventionally used for formation of the grain layer of a grain-finished artificial leather can be used without any particular limitation. Specific examples thereof include polyurethanes, acrylic elastic polymers, diene-based rubbers, nitrile-based rubbers, silicone rubbers, olefin-based rubbers, fluorine-based rubbers, polystyrene-based elastomers, acrylonitrile-styrene copolymers or hydrogenated products or epoxidized products thereof, polyolefin-based elastomers, polyester-based elastomers, nylon-based elastomers, and halogen-based elastomers. These may be used alone or in a combination of two or more. Among these, polyurethanes and acrylic elastic polymers are preferable. If necessary, additives such as a colorant, a softening agent, a fiber ordering agent, an anti-fouling agent, a hydrophilizing agent, a lubricant, a degradation inhibitor, an ultraviolet absorber, and a flame retardant may be mixed in the grain layer.

In this manner, the grain-finished artificial leather of the present embodiment is obtained. The apparent density of the grain-finished artificial leather of the present embodiment is preferably 0.60 to 0.85 g/cm$^3$, more preferably 0.65 to 0.80 g/cm$^3$, because a high level of fullness can be achieved.

The grain-finished artificial leather of the present embodiment also has suppleness similar to that of a natural leather. Specifically, the grain-finished artificial leather has a bending resistance as measured using a softness tester, of preferably 3.5 mm or more, more preferably 4.0 mm or more when the thickness is 0.5 mm, preferably 3.0 mm or more when the thickness is 0.7 mm, preferably 2.5 mm or more when the thickness is 1 mm, preferably 3.0 mm or more when the thickness is 1.0 mm, and preferably 2.0 mm or more when the thickness is 1.5 mm.

The grain-finished artificial leather of the present embodiment is characterized in that fine fold creases are formed on the surface of the grain layer. Specifically, it is preferable that the grain-finished artificial leather exhibits the following surface roughness, for example, in a grain-layer-crease forming test in accordance with ASTM D-294, or ALCA E64. Preferably, the arithmetic mean height $S_a$ of a surface of the grain layer is 30 μm or less when the grain-finished artificial leather is bent, with the grain layer thereof located on the inner side, so as to extend in a semicircular shape along the outer surface of the break/pipiness scale, which is a cylindrical mandrel having an outer radius of 8.7 mm and including a window with a size of approximately 20×10 mm. When the grain-finished artificial leather exhibits such an arithmetic mean height $S_a$, fine fold creases similar to those of a natural leather are formed on the grain layer.

More specifically, the above-described arithmetic mean height $S_a$ is measured in the following manner. The grain-finished artificial leather is bent, with the grain layer thereof located on the inner side, so as to extend in a semicircular shape along the outer surface of the break/pipiness scale. Then, an image of the portion, in which irregularities due to fold creases have been generated, of the surface of the grain layer in the bent state is captured through the window using a microscope. Then, the arithmetic mean height $S_a$ of that portion is measured from the microscope image.

The arithmetic mean height $S_a$ of the grain layer of the grain-finished artificial leather is preferably 30 μm or less, more preferably 5 to 30 μm, particularly preferably 7 to 20 μm, quite particularly preferably 8 to 15 μm. When the arithmetic mean height $S_a$ is too large, large fold creases are generated upon bending, resulting in a grain-finished artificial leather having poor luxurious quality. When the arithmetic mean height $S_a$ is too small, fold creases similar to those of a PVC artificial leather, which looks as if thick films are laminated, are generated, resulting in a grain-finished artificial leather having poor luxurious quality. A surface having an arithmetic mean height $S_a$ in the above-described preferable range is likely to be obtained by producing a grain-finished artificial leather using the above-described artificial leather base material.

The grain-finished artificial leather of the present embodiment has the formability of fine fold creases, suppleness, and surface smoothness, and also has a texture with fullness, similar to those of a natural leather. In particular, in the case of forming a grain-finished artificial leather including a coated surface having a small thickness as that of a natural leather or a flat-grain, grain-finished artificial leather, it is possible to obtain a grain-finished artificial leather having excellent luxurious quality, including the formability of fine fold creases, suppleness, surface smoothness, and a texture with fullness similar to those of a natural leather. Such a grain-finished artificial leather can be suitably used in various applications for which luxurious quality is required, such as shoes, bags, interior goods, wall coverings, and general merchandise.

EXAMPLES

Hereinafter, the present invention will be described more specifically by way of examples. It should be appreciated that the scope of the present invention is by no means limited by the examples.

Example 1

<Production of Artificial Leather Base Material>

Polyethylene (PE) was used as the sea component, and 6-nylon (6Ny) was used as the island component. Each of PE and 6NY was supplied to a multicomponent fiber spinning spinneret set at a spinneret temperature of 260° C. and having nozzle holes disposed in parallel so as to form a cross section on which 200 island component portions with a uniform cross-sectional area were distributed in the sea component, and the molten strand was discharged from the nozzle holes. At this time, PE and 6NY were supplied while adjusting the pressure such that the mass ratio between the sea component and the island component satisfies Sea component/Island component=50/50.

Then, the discharged molten fibers were stretched by suction using a suction apparatus so as to provide an average spinning speed of 3700 m/min, and thereby to spin filaments of the island-in-the-sea composite fibers having a fineness of 2.5 dtex. The spun filaments of the island-in-the-sea composite fibers were continuously piled on a movable net, and thereafter lightly pressed with a metal roll at 42° C. in order to suppress the fuzzing on the surface. Then, the piled filaments of the island-in-the-sea composite fibers that had been removed from the net were allowed to pass between a grid-patterned metal roll having a surface temperature of 55° C. and a back roll, to hot press the filaments with a linear load of 200 N/mm. In this manner, a filament web having a basis weight of 34 g/m$^2$ was obtained.

Twelve layers of the obtained filament web were stacked using a cross lapper apparatus so as to have a total basis weight of 400 g/m$^2$, and an oil solution for preventing the needle from breaking was sprayed thereto, and, thereafter, the filament web was needle-punched alternately from both sides at a density of 2500 punch/cm$^2$ at a punching depth of 10 mm, using a 1-barb needle with a distance of 3.2 mm from the needle tip to the first barb. The area shrinkage of the filament web due to the needle punching was 75%. In this manner, an entangled web having a basis weight of 540 g/m$^2$ was obtained.

Then, the entangled web was heat-treated at 140° C., and thereafter pressed to smooth the surface, to adjust the apparent density to 0.33 g/cm$^3$. Then, a liquid mixture was prepared in which calcium carbonate having an average particle size 2.5 μm was mixed with an N-methyl formamide (DMF) solution of a polyetherester polyurethane having a solid content of 15 mass % at a solid content ratio of 57/43. Note that the polyetherester polyurethane had a 100% modulus of 8.0 MPa and a glass transition temperature (Tg) of −40° C. Then, the liquid mixture was impregnated into the entangled web, and then solidified in a liquid mixture of DMF and water, followed by washing with water. Then, PE as the sea component in the island-in-the-sea composite fibers was removed by dissolution in hot toluene, and dried at 140° C., to produce an intermediate including a fiber-entangled body in which fiber bundles each including 200 ultrafine filaments having a fineness of 0.01 dtex were three-dimensionally entangled.

Then, the intermediate was buffed, and thus finished into a fiber-entangled body-containing sheet having a thickness of approximately 1.45 mm. Then, the obtained fiber-entangled body-containing sheet was subjected to softening processing by being shrunk by 3.0% in a longitudinal direction (length-wise direction) through treatment using a shrinkage processing apparatus (sanforizing machine manufactured by Komatsubara Tekko K.K.) at a drum temperature of 120° C. in the shrinking portion, a drum temperature of 120° C. in the heat setting portion, and a transport speed of 10 m/min, thereby to obtain an artificial leather base material. The artificial leather base material had a thickness of 1.4 mm, a basis weight of 840 g/m$^2$, and an apparent density of 0.60 g/cm$^3$. The content ratios of the components were 39 mass % for the fiber-entangled body, 35 mass % for the polyurethane, and 26 mass % for the calcium carbonate. The apparent densities of the components in the artificial leather base material were 0.23 g/cm$^3$ for the fiber-entangled body, 0.21 g/cm$^3$ for the polyurethane, and 0.16 g/cm$^3$ for the calcium carbonate. The ratio of the polyurethane to the total amount of the polyurethane and the calcium carbonate was 57 mass %, and the total apparent density of the polyurethane and the calcium carbonate was 0.37 g/cm$^3$.

<Formation of Grain Layer>

A grain-like resin layer was formed on the obtained artificial leather base material by direct coating, to produce a grain-finished artificial leather. Specifically, a polyurethane solution was applied to the surface of the artificial leather base material using a reverse coater, and dried, to form an undercoat layer such that the water absorption time when 3 cc of water droplets were dripped was 3 minutes or more. Then, a skin layer-forming resin solution including a pigment and a polyurethane was applied to the surface of the undercoat layer, to form a skin layer having a thickness of 30 μm. Then, a topcoat (lacquer) that had been adjusted to 30 cp using the Iwata Cup (IWATA NK-2 12s) was spray coated to the surface of the skin layer, to form a topcoat layer having a thickness of 30 μm. Then, the topcoat layer was subjected to flat-roll ironing, to obtain a flat-grain, grain-finished artificial leather.

In this manner, a grain-finished artificial leather having a thickness of 1.44 mm, a basis weight of 910 g/m$^2$, and an apparent density of 0.62 g/m$^3$ was obtained.

<Evaluation of Grain-Finished Artificial Leather>

The obtained grain-finished artificial leather was evaluated according to the following evaluation methods.

(Arithmetic Mean Height $S_a$ of Surface of Grain Layer when Grain-Finished Artificial Leather is Bent Using Break/Pipiness Scale, with Grain Layer on Inner Side)

An STD174 manufactured by SATRA, which was the break/pipiness scale, was provided. Note that the break/pipiness scale is a cylindrical mandrel having an outer radius of 8.7 mm and including a window with a size of approximately 20×10 mm, and is used for a grain layer crease test in accordance with ASTM D-294 or ALCA E64. The grain-finished artificial leather was bent so as to extend along the semicircular shape of the outer surface of the mandrel of the break/pipiness scale such that the grain layer was located on the inner side. Then, through the window with a size of approximately 20×10 mm, an image of a central portion of the surface of the bent grain layer was captured using "One-Shot 3D Measuring Macroscope VR-3200" (manufactured by KEYENCE CORPORATION), which was a non-contact surface roughness/shape measurement instrument, with a field of view range of 12 mm×9 mm at a magnification of 25×. To correct the curved surface to a flat surface, waviness removal was performed, and the surface roughness Sa was calculated in accordance with ISO 25178 (surface roughness measurement). The measurement was carried out three times, and the average values thereof were used as the numerical values.

(Bending Resistance)

The bending resistance was measured using a softness tester (leather softness measuring instrument ST 300, manufactured by MSA Engineering Systems Limited of the United Kingdom). Specifically, a predetermined ring with a diameter of 25 mm was set on a lower holder of the instrument, and thereafter, the grain-finished artificial leather was set on the lower holder.

Then, a metal pin (diameter: 5 mm) fixed to an upper lever was pressed down toward the grain-finished artificial leather. Then, the upper lever was pressed down, and the value at the time when the upper lever was locked was read. Note that the value indicated the penetration depth, and the larger the value, the suppler the leather was.

(Texture and Fold Crease Formability)

The grain-finished artificial leather was cut to a size of 20×20 cm, to prepare a sample. Then, the appearance of the artificial leather when bent inward at the center of a pattern of irregularities other than the grain, and the appearance of the artificial leather when held, as observed when the surface was viewed, were evaluated according to the following criteria.

A: When bent, the artificial leather bent with roundness, and formed dense and fine fold grain.

B: The artificial leather had a rubber-like texture with strong resiliency, or had a texture with a significantly low degree of fullness, and formed coarse grain when bent.

C: The artificial leather had a hard texture, and caused sharp bending when bent.

(Surface Smoothness)

The grain-finished artificial leather was cut to a size of 20×20 cm, to prepare a sample. Then, the surface of the grain layer was observed, and the extent of the surface unevenness was evaluated according to the following criteria.

A: The surface exhibited excellent flatness with little unevenness, and had luxurious quality with a gloss.

B: The surface had conspicuous unevenness, and was inferior in the luxurious quality.

(Apparent Density)

In compliance with JIS L 1913, the thickness (mm) and the basis weight (g/cm$^2$) were measured, and an apparent density (g/cm$^3$) was calculated from these values. The apparent density of each of the components was calculated by multiplying the total apparent density by the content ratio of the component.

The results of the above evaluation are shown in Table 1 below.

TABLE 1

| Example No. | | 1 | 2 | 3 | 4 | 5 | 6 | 7 | 8 | 9 | 10 |
|---|---|---|---|---|---|---|---|---|---|---|---|
| Fiber-entangled body | Fiber type | 6Ny | | IPA-PET | | 6Ny | | | | | IPA-PET |
| | Fineness (dtex) | | | | 0.01 | | | | 0.4 | 0.025 | 0.1 |
| Fine particles | Fine particle type | Calcium carbonate | Calcium carbonate | Calcium carbonate | Aluminum hydroxide | Talc | Calcium carbonate | Magnesium oxide | Calcium carbonate | Calcium carbonate | Calcium carbonate |
| | Average particle size (μm) | 2.5 | 2.5 | 2.5 | 1.5 | 1 | 10 | 2 | 2.0 | 2.0 | 2.0 |
| | Mohs hardness | 3 | 3 | 3 | 3 | 1 | 3 | 4 | 3 | 3 | 3 |
| Mass ratio of artificial leather base material (wt %) | Fiber-entangled body | 39 | 32 | 66 | 61 | 30 | 33 | 33 | 33 | 30 | 49 |
| | PU | 35 | 29 | 24 | 21 | 25 | 30 | 30 | 30 | 15 | 5 |
| | AR1 | — | 8 | — | 6 | 8 | 9 | 9 | 9 | 14 | 5 |
| | AR2 | — | — | — | — | — | — | — | — | — | — |
| | Elastic polymer (total) | 35 | 37 | 24 | 29 | 33 | 39 | 39 | 39 | 29 | 10 |
| | Fine particles | 26 | 28 | 10 | 10 | 35 | 24 | 24 | 24 | 36 | 39 |
| | Fatty acid ester | — | 3 | — | 2 | 2 | 2 | 2 | 2 | 3 | 6 |
| | Liquid paraffin | — | — | — | — | — | 2 | 2 | 2 | 2 | — |
| | Elastic polymer/(fine particles + elastic polymer) (mass %) | 57 | 57 | 71 | 78 | 49 | 62 | 62 | 62 | 45 | 20 |
| Apparent density of artificial leather base material (g/cm$^3$) | Fiber-entangled body | 0.23 | 0.22 | 0.46 | 0.46 | 0.23 | 0.22 | 0.22 | 0.19 | 0.20 | 0.39 |
| | PU | 0.21 | 0.20 | 0.17 | 0.16 | 0.19 | 0.20 | 0.20 | 0.17 | 0.10 | 0.04 |
| | AR | — | 0.05 | — | 0.05 | 0.06 | 0.06 | 0.06 | 0.05 | 0.09 | 0.04 |
| | Fine particles | 0.16 | 0.19 | 0.07 | 0.08 | 0.26 | 0.16 | 0.16 | 0.14 | 0.23 | 0.31 |
| | Plasticizer | — | 0.020 | — | 0.015 | 0.015 | 0.027 | 0.027 | 0.023 | 0.330 | 0.016 |
| | Elastic polymer + fine particles | 0.37 | 0.44 | 0.23 | 0.28 | 0.51 | 0.43 | 0.43 | 0.37 | 0.42 | 0.39 |
| | Total | 0.60 | 0.68 | 0.69 | 0.76 | 0.75 | 0.68 | 0.68 | 0.60 | 0.65 | 0.80 |
| Elastic polymer mixed | | PU only | PU + AR1 | PU only | PU only | PU only | PU only | PU only | PU only | PU +AR1 | AR2 |
| Grain-finished artificial leather | Sa (μm) | 15 | 9 | 10 | 7 | 12 | 30 | 16 | 28 | 22 | 28 |
| | Bending resistance (mm) | 3.6 | 2.8 | 3.4 | 2.4 | 2.7 | 2.7 | 2.5 | 3 | 2.5 | 2.4 |
| | Texture and fold creases | A | A | A | A | A | A | A | A | A | A |
| | Surface smoothness | A | A | A | A | A | A | A | A | A | A |

Example 2

An aqueous dispersion including 10 mass % of calcium carbonate having an average particle size of 2.5 μm, 10 mass % of an acrylic elastic polymer (AR1), and 4.0 mass % of a fatty acid ester was prepared. Note that the acrylic elastic polymer AR1 had a 100% modulus of 0.8 MPa and a Tg of −17° C. Then, the aqueous dispersion was impregnated into the same fiber-entangled body-containing sheet as that obtained in Example 1 at a pick-up rate of 100%, and thereafter the moisture was dried at 120° C. Then, the fiber-entangled body-containing sheet was subjected to softening processing by being shrunk by 5.0% in a longitudinal direction (length-wise direction) through treatment using a shrinkage processing apparatus (sanforizing machine manufactured by Komatsubara Tekko K.K.) at a drum temperature of 120° C. in the shrinking portion, a drum temperature of 120° C. in the heat setting portion, and a transport speed of 10 m/min, thereby to obtain an artificial leather base material having a thickness of 1.4 mm. A grain-finished artificial leather having a thickness of 1.44 mm was obtained in the same manner as in Example 1, except that the aforementioned artificial leather base material was used in place of the artificial leather base material of Example 1, and evaluation was performed in the same manner. The results are shown in Table 1.

Example 3

Polyethylene (PE) was used as the sea component, and isophthalic acid-modified polyethylene terephthalate (IPA-PET) having a degree of modification of 6 mol % was used as the island component. Each of PE and IPA-PET was supplied to a multicomponent fiber spinning spinneret having nozzle holes disposed in parallel so as to form a cross section on which 200 island component portions with a uniform cross-sectional area were distributed in the sea component, and set at a spinneret temperature of 260° C., and the molten strand was discharged from the nozzle holes. At this time, PE and IPA-PET were supplied while adjusting the pressure such that the mass ratio between the sea component and the island component satisfies Sea component/Island component=30/70.

Then, the discharged molten fibers were stretched by suction using a suction apparatus so as to provide an average spinning speed of 3700 m/min, and thereby to spin filaments of the island-in-the-sea composite fibers having a fineness of 3.3 dtex. The spun filaments of the island-in-the-sea composite fibers were continuously piled on a movable net, and thereafter lightly pressed with a metal roll at 42° C. in order to suppress the fuzzing on the surface. Then, the piled filaments of the island-in-the-sea composite fibers that had been removed from the net were allowed to pass between a grid-patterned metal roll having a surface temperature of 55° C. and a back roll, to hot press the filaments with a linear load of 200 N/mm. In this manner, a filament web having a basis weight of 32 g/m$^2$ was obtained.

Twelve layers of the obtained filament web were stacked using a cross lapper apparatus so as to have a total basis weight of 375 g/m$^2$, and an oil solution for preventing the needle from breaking was sprayed thereto, and, thereafter, the filament web was needle-punched alternately from both sides at a density of 2800 punch/cm$^2$ at a punching depth of 10 mm, using a 1-barb needle with a distance of 3.2 mm from the needle tip to the first barb. The area shrinkage of the filament web due to the needle punching was 70%. In this manner, an entangled web having a basis weight of 600 g/m$^2$ was obtained.

An artificial leather base material having a thickness of 1.4 mm and a grain-finished artificial leather having a thickness of 1.44 mm were obtained in the same manner as in Example 1, except that the above-described entangled web was used in place of the entangled web of Example 1, and evaluation was performed in the same manner. The results are shown in Table 1.

Examples 4 to 10

Artificial leather base materials having a thickness of 1.4 mm and grain-finished artificial leathers having a thickness of 1.44 mm were obtained by the same method as that used in Examples 1 to 3, except that the compositions of the components were changed as shown in Table 1, and evaluation was performed in the same manner. The results are shown in Table 1.

Comparative Example 1

An artificial leather base material having a thickness of 1.4 mm and a grain-finished artificial leather having a thickness of 1.44 mm were obtained in the same manner as in Example 1, except that the calcium carbonate was not added, and evaluation was performed in the same manner. The results are shown in Table 2 below.

TABLE 2

| Comparative Example No. | | Com. Ex. 1 | Com. Ex. 2 | Com. Ex. 3 | Com. Ex. 4 | Com. Ex. 5 | Com. Ex. 6 | Com. Ex. 7 | Com. Ex. 8 | Com. Ex. 9 |
|---|---|---|---|---|---|---|---|---|---|---|
| Fiber-entangled body | Fiber type | 6Ny | | IPA-PET | | 6Ny | | IPA-PET | | |
| | Fineness (dtex) | 0.01 | | | | | | 0.1 | | |
| Fine particles | Fine particle type | — | Alumina | Calcium carbonate | Calcium carbonate | Calcium carbonate | Calcium carbonate | Aluminum dialkylphosphinate | | |
| | Average particle size (μm) | — | 12 | 2.5 | 2.5 | 2.0 | 2.0 | 5 | 5 | 5 |
| | Mohs hardness | — | 9 | 3 | 3 | 3 | 3 | 2 | 2 | 2 |
| Mass ratio of artificial leather base material (wt %) | Fiber-entangled body | 62 | 24 | 70 | 62 | 35 | 48 | 88.5 | 76.9 | 84.0 |
| | PU | 38 | 18 | 8 | 6 | 20 | 42 | 1.3 | 1.2 | 1.3 |
| | AR1 | — | — | — | — | — | 5 | — | — | — |
| | AR2 | — | 30 | — | — | — | — | — | — | — |
| | Elastic polymer (total) | 38 | 48 | 8 | 6 | 20 | 47 | 1.3 | 1.2 | 1.3 |
| | Fine particles | — | 28 | 20 | 32 | 45 | 5 | 9.7 | 19.2 | 9.2 |
| | Fatty acid ester | — | — | 2 | — | — | — | — | — | — |
| | Liquid paraffin | — | — | — | — | — | — | 0.4 | 2.7 | 5.5 |
| | Elastic polymer/(fine particles + elastic polymer) (mass %) | 100 | 63 | 29 | 16 | 31 | 90 | 12 | 6 | 12 |
| Apparent density of artificial leather base material (g/cm$^3$) | Fiber-entangled body | 0.24 | 0.18 | 0.49 | 0.55 | 0.27 | 0.37 | 0.56 | 0.51 | 0.56 |
| | PU | 0.14 | 0.14 | 0.06 | 0.05 | 0.15 | 0.18 | 0.008 | 0.008 | 0.008 |
| | AR | — | 0.23 | — | — | — | 0.02 | — | — | — |
| | Fine particles | — | 0.21 | 0.14 | 0.28 | 0.35 | 0.02 | 0.06 | 0.13 | 0.06 |
| | Plasticizer | — | — | 0.014 | — | — | — | 0.003 | 0.018 | 0.036 |
| | Elastic polymer + fine particles | 0.14 | 0.57 | 0.20 | 0.33 | 0.50 | 0.22 | 0.07 | 0.13 | 0.07 |
| | Total | 0.38 | 0.75 | 0.70 | 0.88 | 0.77 | 0.43 | 0.63 | 0.66 | 0.66 |
| Elastic polymer mixed | | — | AR2 | PU only | PU only | PU only | AR2 | PU only | PU only | PU only |
| Grain-finished artificial leather | Sa (μm) | 51 | 33 | 38 | 35 | 40 | 44 | 36 | 35 | 38 |
| | Bending resistance (mm) | 3 | 1.2 | 2.8 | 1.4 | 2.6 | 2.8 | 1.9 | 2.2 | 2.2 |
| | Texture and fold creases | E | C | B | C | B | B | B | B | B |
| | Surface smoothness | B | B | A | B | B | B | A | A | A |

Comparative Example 2

An artificial leather base material having a thickness of 1.4 mm and a grain-finished artificial leather having a thickness of 1.44 mm were obtained in the same manner as in Example 2, except that the calcium carbonate was changed to alumina having an average particle size of 12 μm shown in Table 2, and the acrylic elastic polymer (AR1) was changed to an acrylic elastic polymer (AR2) having a 100% modulus of 7.0 MPa and a Tg of 20° C., and the compositions of the components included in the artificial leather base material were changed as shown in Table 1, and evaluation was performed in the same manner. The results are shown in Table 2.

Comparative Examples 3 to 6

Artificial leather base materials having a thickness of 1.4 mm and grain-finished artificial leathers having a thickness of 1.44 mm were obtained in the same manner as in the Examples, except that the compositions of the components included in the artificial leather base material were changed as shown in Table 2, and evaluation was performed in the same manner. The results are shown in Table 2.

Comparative Examples 7 to 9

The same grain-finished artificial leathers as the grain-finished artificial leathers produced in Examples 1, 9, and 10 described in WO 2014/132630 were produced, and evaluation was performed in the same manner. The results are shown in Table 2.

In the case of using the artificial leather base materials obtained in Examples 1 to 10 according to the present invention, the arithmetic mean height $S_a$ of the portion, in which fold creases had been generated, of the surface of the grain layer when the grain layer was caused to extend along the semicircular shape was 30 μm or less, so that grain-finished artificial leathers that had fine fold creases, a bending resistance of 2 mm or more, and a flexible texture, and were also excellent in surface smoothness and fullness were obtained. On the other hand, the grain-finished artificial leather using the artificial leather base material obtained in Comparative Example 1, in which the fine particles were not included, formed coarse fold creases, and also had poor fullness and poor surface smoothness. The grain-finished artificial leather using the artificial leather base material obtained in Comparative Example 2, in which alumina having a large average particle size was used as the fine particles, and the total specific gravity of the elastic polymer and the fine particles exceeded 0.55 g/cm$^3$, had a poor texture, caused sharp bending to form coarse fold creases, and was also inferior in the surface smoothness. The grain-finished artificial leather using the artificial leather base material obtained in Comparative Example 3, in which the total apparent density of the elastic polymer and the fine particles was less than 0.25 g/cm$^3$, formed coarse fold creases, and also had a poor surface smoothness. The grain-finished artificial leather using the artificial leather base material obtained in Comparative Example 4, in which the ratio of the elastic polymer to the total amount of the elastic polymer and the fine particles was less than 20 mass %, and the total apparent density exceeded 0.80 g/cm$^3$, had a hard texture, and was inferior in the fold crease formability and the surface smoothness. Similarly, the grain-finished artificial leather using the artificial leather base material obtained in Comparative Example 5, in which the content ratio of the fine particles exceeded 40 mass %, formed coarse fold creases, and also had a poor surface smoothness. Similarly, the grain-finished artificial leather using the artificial leather base material obtained in Comparative Example 6, in which the content ratio of the fine particles was less than 10 mass %, formed coarse fold creases, and also had a poor surface smoothness. Comparative Examples 7 to 8, in which the ratio of the elastic polymer to the total amount of the elastic polymer and the fine particles was less than 20 mass %, formed coarse fold creases.

Industrial Applicability

With a grain-finished artificial leather obtained using the grain-finished artificial leather base material according to the present invention, an artificial leather base material exhibiting fine fold creases, suppleness, and surface smoothness, and also a texture with fullness, similar to those of a natural leather, can be obtained as a grain-finished artificial leather base material including a fiber-entangled body, and the grain-finished artificial leather can be suitably used in applications such as shoes, bags, clothing, gloves, interior goods, vehicle interior finishing, transport interior finishing, and building interior finishing.

The invention claimed is:

1. A grain-finished artificial leather comprising:

an artificial leather base material; and a grain layer stacked on the artificial leather base material, wherein the artificial leather base material comprises a fiber-entangled body comprising ultrafine fibers having an average fineness of 0.4 dtex or less, an elastic polymer, and fine particles having an average particle size of 10 μm or less, and a content ratio of the fine particles is 10 to 40 mass %, and a ratio of the elastic polymer to a total amount of the elastic polymer and the fine particles is 20 to 80 mass %, and a total of an apparent density of the elastic polymer and an apparent density of the fine particles is 0.23 to 0.55 g/cm$^3$.

2. The grain-finished artificial leather according to claim 1, wherein the artificial leather base material has a content ratio of the fiber-entangled body of 30 to 80 mass %, and a content ratio of the elastic polymer of 10 to 40 mass %.

3. The grain-finished artificial leather according to claim 1, wherein the fine particles are attached to the elastic polymer.

4. The grain-finished artificial leather according to claim 1, wherein the elastic polymer comprises a polyurethane and an acrylic elastic polymer.

5. The grain-finished artificial leather according to claim 1, wherein the fine particles have a Mohs hardness of 1 to 4.

6. The grain-finished artificial leather according to claim 1, wherein the fine particles comprises at least one selected from the group consisting of talc, magnesium silicate, calcium sulfate, aluminum silicate, calcium carbonate, magnesium oxide, magnesium carbonate, magnesium hydroxide, aluminum hydroxide, and mica.

7. The grain-finished artificial leather according to claim 1, wherein the artificial leather base material further comprises a plasticizer.

8. The grain-finished artificial leather according to claim 1, wherein the plasticizer is liquid at 23° C.

9. The grain-finished artificial leather according to claim 1, wherein the artificial leather base material has an apparent density of 0.45 to 0.85 g/cm$^3$.

10. The grain-finished artificial leather according to claim 1, wherein the ultrafine fibers comprise nylon ultrafine fibers having an average fineness of 0.025 dtex or less.

11. The grain-finished artificial leather according to claim 1, wherein an arithmetic mean height $S_a$ of a surface of the grain layer is 30 μm or less when the grain-finished artificial leather is caused to extend in a semicircular shape along an outer surface of a cylindrical mandrel having an outer radius of 8.7 mm, with the grain layer located on an inner side.

12. A method for producing a grain-finished artificial leather, the method comprising:

preparing an artificial leather base material; and forming a grain layer on a surface of the artificial leather base material by direct coating, wherein the artificial leather base material comprises a fiber-entangled body comprising ultrafine fibers having an average fineness of 0.4 dtex or less, an elastic polymer, and fine particles having an average particle size of 10 μm or less, a content ratio of the fine particles is 10 to 40 mass %, and a ratio of the elastic polymer to a total amount of the elastic polymer and the fine particles is 20 to 80 mass %, and a total of an apparent density of the elastic polymer and an apparent density of the fine particles is 0.23 to 0.55 g/cm$^3$.

13. The method according to claim 12, wherein the forming comprises:

forming an undercoat layer by applying a solution of an undercoat layer-forming elastic polymer to a surface of the artificial leather base material, followed by drying; and forming a skin layer by applying a resin solution including a skin layer-forming elastic polymer to a surface of the undercoat layer.

14. The method according to claim 13, wherein a water absorption time when 3 cc of water droplets are dripped to the surface of the undercoat layer is 3 minutes or more.

* * * * *